US012708180B2

(12) United States Patent
Dhami

(10) Patent No.: US 12,708,180 B2
(45) Date of Patent: Aug. 18, 2026

(54) METHODS, SYSTEMS AND COMPUTER READABLE MEDIA FOR PROVIDING A USER INTERFACE FOR HTML SAP APPLICATIONS

(71) Applicant: Precisely Software Incorporated, Burlington, MA (US)

(72) Inventor: Harsimran Singh Dhami, Zirakpur (IN)

(73) Assignee: Precisely Software Incorporated, Burlington, MA (US)

( * ) Notice: Subject to any disclaimer, the term of this patent is extended or adjusted under 35 U.S.C. 154(b) by 314 days.

(21) Appl. No.: 18/216,896

(22) Filed: Jun. 30, 2023

(65) Prior Publication Data

US 2024/0000192 A1 Jan. 4, 2024

(51) Int. Cl.
*A43C 11/14* (2006.01)

(52) U.S. Cl.
CPC ..... *A43C 11/14* (2013.01)

(58) Field of Classification Search
CPC ..... A43C 11/14
See application file for complete search history.

(56) References Cited

U.S. PATENT DOCUMENTS

2022/0179665 A1* 6/2022 Rathod ..... G06F 9/451
2022/0215937 A1* 7/2022 Gelber ..... G16H 40/20
2022/0247797 A1* 8/2022 Leduc ..... H04L 12/1822
2023/0092823 A1* 3/2023 Tosswill ..... G06Q 30/0201 705/14.49
2023/0368140 A1* 11/2023 Ghosh ..... G06Q 10/101

OTHER PUBLICATIONS

Mohammed Abdul Qadeer, Network Traffic Analysis and Intrusion Detection Using Packet Sniffer, 2010, p. 313-314 (Year: 2010).*

* cited by examiner

*Primary Examiner* — Ibrahim N El-Bathy
(74) *Attorney, Agent, or Firm* — KDW FIRM PLLC

(57) ABSTRACT

A method for providing a user interface for HTML SAP applications includes identifying, by a user device and among network traffic generated for at least an SAP application, representational state transfer application programming interface (REST API) calls sent to a server. The method further includes identifying, by the user device, user-filled keys in the identified REST API calls. The method further includes displaying, by a user interface on the user device, the user-filled keys. The method further includes receiving user input for the user-filled keys on the user interface. The method further includes updating the REST API calls based on the received user input and executing the updated REST API calls. The method further includes displaying responses to the REST API calls from the server on the user interface.

7 Claims, 2 Drawing Sheets

METHODS, SYSTEMS AND COMPUTER READABLE MEDIA FOR PROVIDING A USER INTERFACE FOR HTML SAP APPLICATIONS

TECHNICAL FIELD

The subject matter described herein relates to user interfaces for business processes. More particularly, the subject matter described herein relates to methods, systems, and computer readable media for providing a user interface for HTML SAP applications.

BACKGROUND

SAP provides Enterprise Resource Planning software catering to business processes within an enterprise. Employees of an enterprise use SAP in their day-to-day business processes ranging from raw material purchase to production. SAP provides a graphical user interface (GUI) for HyperText Markup Language (HTML) to work on SAP applications using a web browser called Web-GUI. SAP develops software for different business processes of an enterprise. Each such process is represented by a Transaction Code or T-Code. Enterprises use these Transaction Codes to work on SAP through SAP Web-GUI. For example, VA01 is the T-Code for creating a sales order.

Among various options available in SAP for entering business data are Fiori applications, which are HTML applications. There are various types of SAP Fiori applications including type SAP GUI. Users access SAP Fiori applications of type GUI, also referred to herein as SAP Fiori GUI applications or Fiori GUI applications, via a web browser. While working on SAP Web-GUI and SAP Fiori applications of type SAP GUI, users need to work via a web browser on a user interface provided by SAP. Working on a web browser is relatively slower than working on interfaces such as Microsoft Excel, especially when a user is working on bulk activities such as creating 100 sales orders.

SUMMARY

The subject matter described herein includes methods, systems, and computer readable media for providing a user interface for HTML SAP applications. A method for providing a user interface for HTML SAP applications including identifying, by a user device and among network traffic generated for at least an SAP application, representational state transfer application programming interface (REST API) calls sent to a server. The method further includes identifying, by the user device, user-filled keys in the identified REST API calls. The method further includes displaying, by a user interface on the user device, the user-filled keys. The method further includes receiving user input for the user-filled keys on the user interface. The method further includes updating the REST API calls based on the received user input and executing the updated REST API calls. The method further includes displaying responses to the REST API calls from the server on the user interface.

A system for providing a user interface for HTML SAP applications includes a processor, a memory communicatively connected to the processor, and user device implemented using the processor and the memory. The user device is configured for identifying, among network traffic generated for at least an SAP application, representational state transfer application programming interface (REST API) calls sent to a server. The user device is further configured for identifying user-filled keys in the identified REST API calls. The user device is further configured for displaying, by a user interface on the user device, the user-filled keys. The user device is further configured for receiving user input for the user-filled keys on the user interface. The user device is further configured for updating the REST API calls based on the received user input and executing the updated REST API calls. The user device is further configured for displaying responses to the REST API calls from the server on the user interface.

The subject matter described herein may be implemented in or with software in combination with hardware and/or firmware. For example, the subject matter described herein may be implemented in or with software executed by a processor. In one example implementation, the subject matter described herein may be implemented using a computer readable medium having stored thereon computer executable instructions that when executed by the processor of a computer control the computer to perform steps. Example computer readable media suitable for implementing the subject matter described herein include non-transitory devices, such as disk memory devices, chip memory devices, programmable logic devices, and application-specific integrated circuits. In addition, a computer readable medium that implements the subject matter described herein may be located on a single device or computing platform or may be distributed across multiple devices or computing platforms.

BRIEF DESCRIPTION OF THE DRAWINGS

Embodiments of the subject matter described herein will now be explained with reference to the accompanying drawings, wherein like reference numerals represent like parts, of which.

DETAILED DESCRIPTION

The subject matter described herein includes methods, systems, and computer readable media for providing a user interface for SAP applications. The user interface may be configured to replace SAP's graphical user interface (GUI) Web-GUI for TCodes and/or to access SAP Fiori applications of type SAP GUI, also referred to herein as SAP Fiori GUI applications, that would otherwise require use of a web browser. The user interface receives user input and updates requests to an SAP server based on the user input, thus allowing a user to enter business information more quickly on SAP applications by not implementing a web browser.

Figure 1:
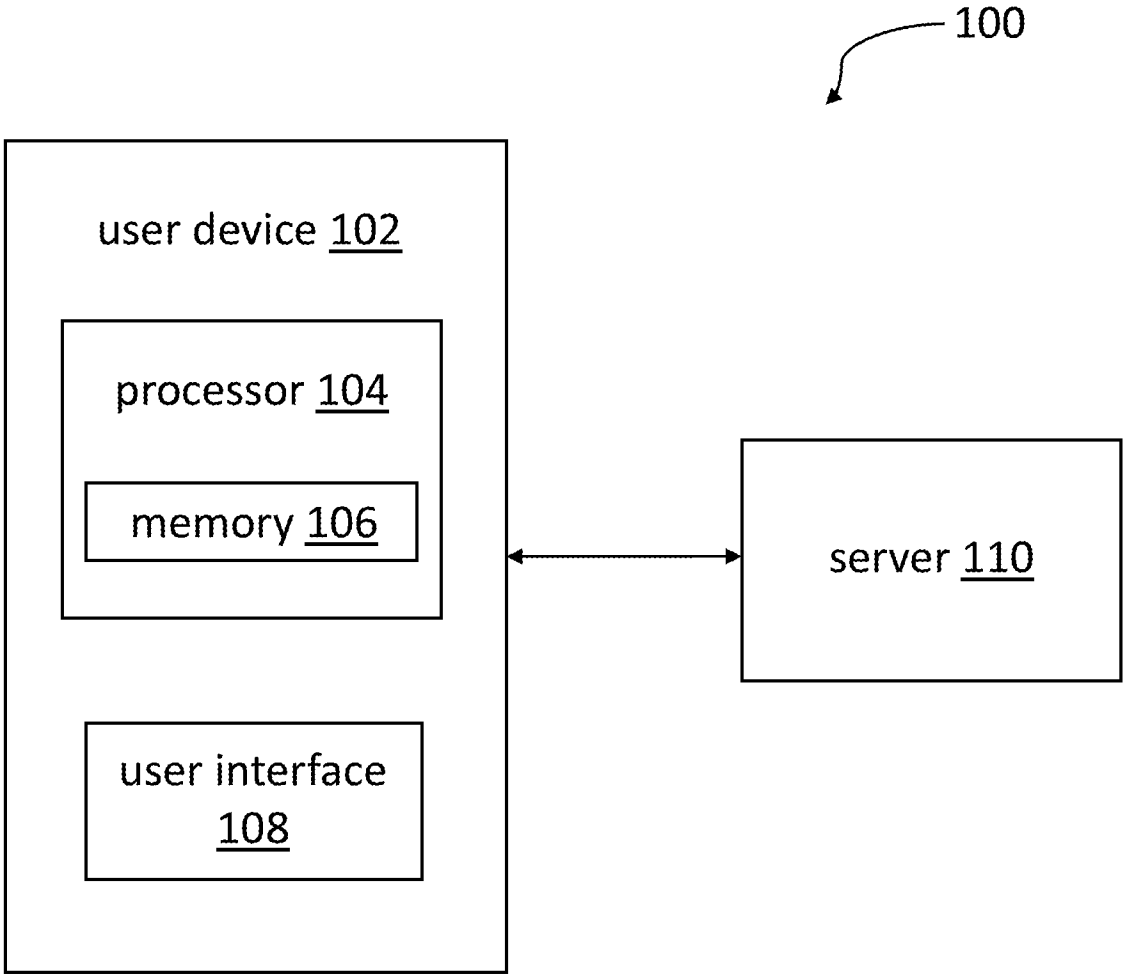
FIG. 1 is a block diagram of an example system for bulk data validation for providing a user interface for HTML SAP applications according to an embodiment of the presently disclosed subject matter.

FIG. 1 is a block diagram illustrating an example system 100 for providing a user interface for SAP applications, such as a user interface to access SAP applications without implementing a web browser. System 100 may include a user device 102 with at least one processor 104 and memory 106. User device 102 may include a computing device. A computing device may include, without limitation, a microcontroller, microprocessor, digital signal processor (DSP) and/or system on a chip (SoC) as described herein. A computing device may include, be included in, and/or communicate with a mobile device such as a mobile telephone or smartphone. A computing device may include a single computing device operating independently, or may include two or more computing device operating in concert, in parallel, sequentially or the like; two or more computing devices may be included together in a single computing device or in two or more computing devices.

User device 102 may include a user interface 108 configured for accessing SAP applications without implementing a web browser. User interface 108 may be configured to replace SAP's graphical user interface (GUI) Web-GUI and/or to access SAP Fiori applications of type SAP GUI, also referred to herein as SAP Fiori GUI applications. User device 102 may be configured for analyzing network traffic generated between a web browser and a server, such as server 110, when a user performs via the web browser an end-to-end business operation on SAP, specifically on SAP Web-GUI and/or on an SAP Fiori GUI application. Server 110 may include a backend server for SAP, such as an SAP Internet Transaction Server (SAP-ITS). Server 110 may include one or more servers in one or more locations. User device 102 may intercept network traffic from server 110 on the world wide web. When a user performs a business activity, for example creating a sales order on a web browser while working on SAP Web-GUI or an SAP Fiori application of type SAP GUI, network traffic is generated which includes fetching a root HTML page, JavaScript files, CSS files and REST calls between the browser and server 110, such as an SAP-ITS. User device 102 may receive the generated network traffic. In some embodiments, user device 102 may export the network traffic from a web browser. User device 102 may capture the network traffic using a third-party library, such as Microsoft Edge® WebView2, CefSharp, and the like. In some embodiments, the network traffic may be manually inputted into user device 102. It is understood that user device 102 may receive network traffic by other means such as tracing activity into a log from a web browser interacting with server 110 when a user is interacting with SAP Web-GUI for TCodes or an SAP Fiori GUI application.

User device 102 may identify representational state transfer (REST) application programming interface (API) calls among the network traffic generated for an SAP application. REST API calls may include JavaScript Object Notation (JSON) format. User device 102 may filter out from the network traffic calls that are non-REST requests to server 110. Each Hypertext Transfer Protocol (HTTP) request in the network traffic has a property named "type". REST API calls set this property to value "xhr". User device 102 may remove all HTTP requests in the received network traffic that do not have property "type" set to "xhr". The remaining HTTP requests are REST API calls. In some embodiments, user device 102 may identify REST API calls by finding HTTP requests with property "type" set to "xhr".

User device 102 may then identify which of the REST API calls are calls sent to server 110, such as calls landing on SAP-ITS. Each REST API call in the network traffic is exposed by server 110 on an endpoint, which includes a unique HTTP address over which a corresponding API can be accessed. User device 102 may identify the calls sent to server 110 based on endpoint Uniform Resource Locators (URLs) of the REST API calls. Each HTTP address includes the format: <http\https>:<Host Name>/<Relative URL>?<query-parameters>. In embodiments wherein user interface 108 is configured to replace SAP Web-GUI for TCodes and/or wherein the user interface 108 is configured to interact with SAP Fiori GUI applications, user device 102 may identify the REST API calls with endpoint URLs containing a relative URL ending with "sap/its/webgui/batch/json". In embodiments wherein user interface 108 is configured to interact with SAP Fiori GUI applications, user device 102 may further identify the REST API calls with endpoint URLs containing a relative URL ending with "sap/bc/ui2/start_up". In case a system administrator created an alias in server 110 for "sap/its/webgui/batch/json" or "sap/bc/ui2/start_up", user device 102 may determine the alias and search for REST API calls with endpoint URLs containing a relative URL ending with that alias.

Each REST API call may have a request body containing multiple parameters, which affects processing of the request by server 110. An example request body of a REST API call is:

```
[
{'content':'100-100','post':'value/wnd[0]/usr/ctxtRMMG1-MATNR'},
{'post':'action/304/wnd[0]/usr/ctxtRMMG1-
MATNR','content':'position=7','logic':'ignore'},
{'post':'focus/wnd[0]/usr/ctxtRMMG1-MATNR','logic':'ignore'},
{'post':'vkey/0/ses[0]'},
{'get':'state/ur'}
]
```

This example request body includes an array of five JSON-based objects. Each JSON object consists of one or more parameters, or keys, each parameter comprising a name-value pair. The first JSON object of the array in this example request body is {'content':'100-100','post':'value/wnd[0]/usr/ctxtRMMG1-MATNR'}, which includes keys "content" and "post" with values "100-100" and "value/wnd[0]/usr/ctxtRMMG1-MATNR", respectively. User device 102 may determine which parameters, or keys, in the request body of a REST API call are user-filled and which are system-filled. A user-filled key, or user-filled parameter, is a key with a value for a user to input. A system-filled key, or system-filled parameter, is a key whose value is determined independently of user input. User device 102 may identify user-filled keys based on the name of the key. For example, a key with name 'logic' and value 'ignore' may be a system-filled key and a key named "content" may be a user-filled key, and user device 102 may identify the keys in the request body accordingly.

User device 102 may display on user interface 108 the identified user-filled keys. User device 102 may receive user input for the user-filled keys and update the values of the user-filled keys in the HTTP requests of the REST API calls based on the received user input. User interface 108 may present the user-filled keys and/or receive user input with a third-party interface such as Microsoft® Excel®, SCV file, Google® Spreadsheet, HTML Page, databases, Airtable®, or any end user interface configured to receive input from a user. Once the user-filled keys in the REST API calls are updated with the received user input, user device 102 may replay the REST API calls identified as being sent to server 110. During the replay of REST API calls, user device 102 may send appropriate authentication cookies and/or authentication headers with each call.

User device 102 may use native HTTP clients of a technology stack including, for example, Microsoft® Dot Net, Java, NodeJS, or the like, to execute the REST API calls. By not implementing a web browser, user device 102 is able to send user input to server 110 faster than otherwise. User device 102 may also use any third-party library to execute the REST API calls. Once a REST API call is replayed, server 110 may return the call to user device 102, which may include a response body with HyperText Markup Language (HTML). User device 102 may display on user interface 108 at least a portion of the response body for a user to review the results of sending the user input to server 110. The HTML in the response body of the REST API call may include an element named "span" with an "id" ending with the string "/sbar_msg_txt". The element "span" may include inner text with a message relevant to the action performed by the user, which user device 102 may present to the user on user interface 108. An example element "span" in a response body is:

```
<span role="presentation" id="wnd[0]/sbar_msg-txt"
class="IsMessageBar__text IsMessageBar__text--overflow"
class="IsMessageBar__text ">No changes made</span>.
```

This example element "span" includes an "id" ending with a string "/sbar_msg_txt" and inner text "No changes made". User device 102 may display the text "No changes made" to user on user interface 108.

Figure 2:
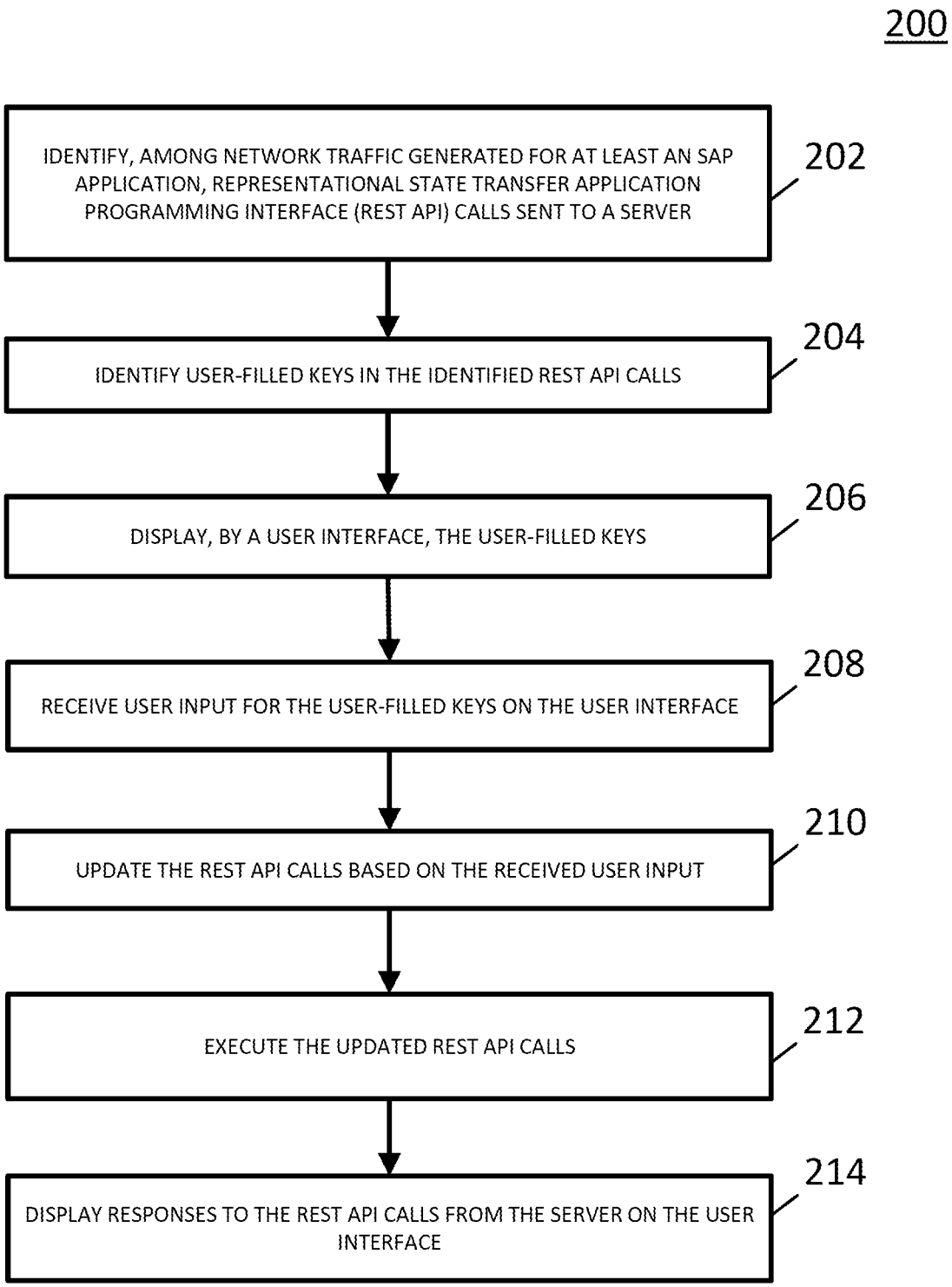
FIG. 2 is a block diagram of an example method providing a user interface for HTML SAP applications according to an embodiment of the presently disclosed subject matter.

FIG. 2 is a block diagram of example method 200 for providing a user interface for SAP Web-GUI TCodes and Fiori SAP GUI applications. In some embodiments, method 200, or portions thereof, may be performed by or at user device 102. In step 202, a user device identifies, among network traffic generated for at least an SAP application, representational state transfer application programming interface (REST API) calls sent to a server. The user device may receive network traffic between the user device and the server generated for the at least an SAP application and captured by a web browser and identify, among the received network traffic, the REST API calls sent to the server. The network traffic generated for at least an SAP application may include network traffic generated between an SAP Web-GUI and the server. The network traffic generated for at least an SAP application may include network traffic generated between an SAP Fiori application of type SAP GUI and the server. The user device may identify the REST API calls sent to the server based on relative URLs of the REST API calls. The user device may determine that the server uses an alias for a relative URL of an endpoint and identify the REST API calls with the alias in relative URLs of the REST API calls.

In step 204, the user device identifies user-filled keys in the identified REST API calls. In step 206, the user device displays, by a user interface on the user device, the user-filled keys. In step 208, the user device receives user input for the user-filled keys on the user interface. In step 210, the user device updates the REST API calls based on the received user input. The user device may update headers of the REST API calls.

In step 212, the user device executes the updated REST API calls. The user device may send the updated REST API calls to the server without a web browser. In step 214, the user device displays responses to the REST API calls from the server on the user interface.

It will be appreciated that method 200 is for illustrative purposes and that different and/or additional actions may be used. It will also be appreciated that various actions described herein may occur in a different order or sequence.

It will be understood that various details of the subject matter described herein may be changed without departing from the scope of the subject matter described herein. Furthermore, the foregoing description is for the purpose of illustration only, and not for the purpose of limitation, as the subject matter described herein is defined by the claims as set forth hereinafter.

What is claimed is:

1. A method for providing a user interface for HTML SAP applications, the method comprising:

upon initiation of a business activity using an SAP Web-GUI application or SAP Fiori GUI application, intercepting, by a user device, network traffic for at least the SAP Web-GUI application or the SAP Fiori GUI SAP application generated between a web browser and a server;

removing, by the user device from the network traffic, HTTP requests from the network traffic that have a property "type" set to a value other than "xhr" to produce filtered network traffic;

identifying, by the user device and among the filtered network traffic, representational state transfer application programming interface (REST API) calls sent to the server by identifying endpoint URLs of the REST API calls that include predetermined relative URL endings;

identifying, by the user device, user-filled keys and system-filled keys in the identified REST API calls based on predetermined key names;

displaying, by a user interface on the user device that is separate from the web browser, the user-filled keys;

receiving, on the user interface, user input for the user-filled keys;

updating, by the user device, the REST API calls based on the received user input;

replaying, by the user device to the server and without the web browser, the updated REST API calls; and displaying, on the user interface, responses to the REST API calls from the server.

2. The method of claim 1 wherein updating the REST API calls comprises updating the REST API calls to include authentication headers.

3. The method of claim 1 wherein identifying the REST API calls sent to the server comprises:

determining, by the user device, that the server uses an alias for a relative URL of an endpoint; and identifying the REST API calls with the alias in relative URLs of the REST API calls.

4. A system for providing a user interface for HTML SAP applications, the method comprising:

a processor;

a memory communicatively connected to the processor; and a user device implemented using the processor and the memory, wherein the user device is configured for:

upon initiation of a business activity using an SAP Web-GUI application or SAP Fiori GUI application, intercepting, by a user device, network traffic for at least the SAP Web-GUI application or the SAP Fiori GUI SAP application generated between a web browser and a server;

removing, by the user device from the network traffic, HTTP requests from the network traffic that have a property "type" set to a value other than "xhr" to produce filtered network traffic;

identifying, among the filtered network traffic, representational state transfer application programming interface (REST API) calls sent to the server by identifying endpoint URLs of the REST API calls that include predetermined relative URL endings;

identifying user-filled keys and system-filled keys in the identified REST API calls based on predetermined key names;

displaying the user-filled keys by a user interface on the user device that is separate from the web browser;

receiving user input for the user-filled keys on the user interface;

updating the REST API calls based on the received user input;

replaying the updated REST API calls to the server and without the web browser; and displaying responses to the REST API calls from the server on the user interface.

5. The system of claim 4 wherein the user device is configured for updating the REST API calls to include authentication headers.

6. The system of claim 4 wherein the user device is configured for identifying the REST API calls sent to the server by:

determining that the server uses an alias for a relative URL of an endpoint; and identifying the REST API calls with the alias in relative URLs of the REST API calls.

7. A non-transitory computer readable medium having stored thereon executable instructions that when executed by at least one processor of at least one computer cause the at least one computer to perform steps comprising:

upon initiation of a business activity using an SAP Web-GUI application or SAP Fiori GUI application, intercepting, by a user device, network traffic for at least the SAP Web-GUI application or the SAP Fiori GUI SAP application generated between a web browser and a server;

removing, by the user device from the network traffic, HTTP requests from the network traffic that have a property "type" set to a value other than "xhr" to produce filtered network traffic;

identifying, among the filtered network traffic generated for at least an SAP application, representational state transfer application programming interface (REST API) calls sent to the server by identifying endpoint URLs of the REST API calls that include predetermined relative URL endings;

identifying user-filled keys and system-filled keys in the identified REST API calls based on predetermined key names;

displaying the user-filled keys by a user interface on the user device that is separate from the web browser;

receiving user input for the user-filled keys on the user interface;

updating the REST API calls based on the received user input;

replaying the updated REST API calls to the server and without the web browser; and displaying responses to the REST API calls from the server on the user interface.

* * * * *